US010994320B2

(12) United States Patent
Zeh et al.

(10) Patent No.: US 10,994,320 B2
(45) Date of Patent: May 4, 2021

(54) METHOD FOR MARKING WORKPIECES AND WORKPIECE

(71) Applicant: Fraunhofer-Gesellschaft zur Förderung der angewandten Forschung e.V., Munich (DE)

(72) Inventors: Christoph Zeh, Dresden (DE); Thomas Härtling, Dresden (DE)

(73) Assignee: Fraunhofer-Gesellschaft zur Förderung der angewandten Forschung e.V., Munich (DE)

( * ) Notice: Subject to any disclaimer, the term of this patent is extended or adjusted under 35 U.S.C. 154(b) by 129 days.

(21) Appl. No.: 16/135,833

(22) Filed: Sep. 19, 2018

(65) Prior Publication Data

US 2019/0030581 A1 Jan. 31, 2019

Related U.S. Application Data

(62) Division of application No. 15/140,580, filed on Apr. 28, 2016, now Pat. No. 10,086,420.

(30) Foreign Application Priority Data

May 18, 2015 (DE) ..... 102015107744.2

(51) Int. Cl.

| | |
|---|---|
| ***B21C 51/00*** | (2006.01) |
| ***B05D 3/02*** | (2006.01) |
| ***B05D 3/00*** | (2006.01) |
| ***B21D 22/20*** | (2006.01) |
| ***B21D 22/00*** | (2006.01) |

(Continued)

(52) U.S. Cl.

CPC ..... *B21C 51/005* (2013.01); *B05D 3/002* (2013.01); *B05D 3/0254* (2013.01); *B05D 7/16* (2013.01); *B05D 7/26* (2013.01); *B21C 51/00* (2013.01); *B21D 22/00* (2013.01); *B21D 22/022* (2013.01); *B21D 22/20* (2013.01); *B21D 22/201* (2013.01); *B41K 99/00* (2013.01); *B41M 1/28* (2013.01); *B05D 2202/00* (2013.01);

(Continued)

(58) Field of Classification Search

CPC ..... B21C 51/005; B21C 51/00; B41K 99/00; B41M 1/28; B05D 7/26; B05D 7/16; B05D 3/002; B05D 3/0254; B05D 2202/00; B05D 2502/00; B05D 2350/60; B21D 22/022; B21D 22/00; B21D 22/20; B21D 22/201; B21D 22/208

See application file for complete search history.

(56) References Cited

U.S. PATENT DOCUMENTS

| | | | |
|---|---|---|---|
| 4,218,362 | A | 8/1980 | Honjo et al. |
| 4,883,720 | A | 11/1989 | Stangl |

(Continued)

FOREIGN PATENT DOCUMENTS

| | | | |
|---|---|---|---|
| DE | 2829449 | A1 | 1/1980 |
| DE | 2750811 | C2 | 4/1989 |

(Continued)

*Primary Examiner* — Nathan L Van Sell

(74) *Attorney, Agent, or Firm* — Slater Matsil, LLP

(57) ABSTRACT

In an embodiment, a workpiece includes a hot-formed metal body and a marking, wherein the marking comprises a phosphor and/or pigments which are at least partly arranged on the metal body and which exhibit a reflection behavior and/or a reflectance behavior and/or an albedo behavior deviating from the metal body.

15 Claims, 4 Drawing Sheets

(51) Int. Cl.

| | |
|---|---|
| ***B21D 22/02*** | (2006.01) |
| ***B05D 7/16*** | (2006.01) |
| ***B05D 7/26*** | (2006.01) |
| ***B41M 1/28*** | (2006.01) |
| ***B41K 99/00*** | (2006.01) |

(52) U.S. Cl.
CPC ..... *B05D 2350/60* (2013.01); *B05D 2502/00* (2013.01); *B21D 22/208* (2013.01)

(56) References Cited

U.S. PATENT DOCUMENTS

| | | | | |
|---|---|---|---|---|
| 6,660,184 | B2 | 12/2003 | Singh et al. | |
| 2005/0158526 | A1* | 7/2005 | Ino | C09D 5/22 428/207 |
| 2009/0038139 | A1 | 2/2009 | Kerschner et al. | |
| 2010/0043695 | A1* | 2/2010 | Reichert | G01N 31/229 116/207 |
| 2010/0173167 | A1* | 7/2010 | Vissing | B05D 3/06 428/447 |
| 2013/0015651 | A1* | 1/2013 | Lau | C09K 11/08 283/74 |
| 2013/0199258 | A1 | 8/2013 | Naitou et al. | |

FOREIGN PATENT DOCUMENTS

| | | | |
|---|---|---|---|
| DE | 19955647 | C1 | 6/2001 |
| DE | 60218966 | T2 | 7/2007 |
| EP | 2549330 | A1 | 1/2013 |
| WO | 2005028575 | A1 | 3/2005 |
| WO | 2010057470 | A2 | 5/2010 |
| WO | 2011101001 | A1 | 8/2011 |

* cited by examiner

METHOD FOR MARKING WORKPIECES AND WORKPIECE

CROSS-REFERENCE TO RELATED APPLICATIONS

This is a divisional application of U.S. application Ser. No. 15/140,580, issued on Oct. 2, 2018 as U.S. Pat. No. 10,086,420 which claims the priority of German patent application 10 2015 107 744.2, filed on May 18, 2015, each of which is incorporated herein by reference.

TECHNICAL FIELD

A method for marking workpieces is specified.

BACKGROUND

The document WO 2011/101001 A1 specifies a method in which metallic components are provided with a phosphor marking.

SUMMARY

Embodiments of the invention provide a method for producing a workpiece, wherein the workpiece is produced by hot forming and wherein the workpiece has an identification marking.

In accordance with at least one embodiment, the method comprises the step of providing a blank. The blank is, for example, a metallic raw material, in particular a metal plate. The blank can be an iron plate or a steel plate. A thickness of the blank is, for example, at least 0.1 mm or 0.3 mm or 0.5 mm and/or at most 8 mm or 5 mm or 3 mm.

In accordance with at least one embodiment, the method comprises the step of applying one or a plurality of markings to the blank. In this case, the marking is preferably applied to the blank only in places and not over the whole area. The marking is applied, for example, in the form of lettering or a number. Preferably, the marking is a machine-readable coding, in particular in the form of a barcode or a two-dimensional code. The marking makes it possible, for instance, to provide the blank with a unique component number.

In accordance with at least one embodiment, the method comprises the step of heating the blank with the marking. The blank, together with the marking, is brought to a deformation temperature in the process. At the deformation temperature, the blank can be processed further, in particular brought to the desired shape. The process of applying the marking is preferably carried out below the deformation temperature, for example, below 300° C. or 100° C., preferably at ambient temperature. The ambient temperature is preferably room temperature, in particular at least 5° C. and/or at most 45° C.

The temperature of the marking, as long as it is in the form of a paste or ink, should be set such that a viscosity and/or an evaporation rate of the marking are/is adapted to the printing process and a good adhesion and drying of the marking on the component are achieved. Depending on the composition of the paste and/or the ink, temperatures of less than 80° C. or room temperature are preferred. The blank and the component itself can also be hotter, for example, in order to support drying of the ink and/or the paste, but may not to be so hot that adhesion of the marking is prevented.

In accordance with at least one embodiment of the method, the blank is deformed to form the workpiece. This is carried out by means of a hot forming, in particular with the aid of a pressing tool. The pressing tool is a mold, for example, which is at a lower temperature than the deformation temperature. It is thus possible that during the process of deforming the blank, the workpiece is at the same time also cooled to a temperature below the deformation temperature, for example, to below 400° C. or 300° C., in particular, to approximately 200° C.

In accordance with at least one embodiment, the marking remains at the workpiece at least until after the process of deforming the blank. As a result of the blank being deformed and also as a result of heating to the deformation temperature, the marking is not destroyed and is maintained in a readable manner.

In accordance with at least one embodiment, the marking has a difference in the degree of reflection and/or a difference in the degree of reflectance and/or a difference in albedo of at least 15 percentage points or 25 percentage points or 50 percentage points at least in part of the near ultraviolet, visible and/or near infrared spectral range both relative to the blank and relative to the workpiece.

In other words, on account of its optical properties the marking is clearly distinguishable both from a surface of the blank before deforming and from a surface of the workpiece after deforming, for example, by a camera or by the human eye. To put it another way, the marking has a high contrast with respect to a surface of the blank and of the workpiece, at least under suitable illumination conditions used for reading the marking. The near ultraviolet spectral range is understood to mean, in particular, the range of 300 nm to 420 nm, the visible spectral range denotes, in particular, wavelengths of 420 nm to 760 nm and the near infrared spectral range denotes wavelengths of 760 nm to 1500 nm. It is possible for optical filters to be used for reading the marking, said optical filters blocking an excitation wavelength of a phosphor, for example, such that only the radiation generated by the phosphor on account of the excitation is then detected. In particular, with regard to contrast and/or a difference in brightness, the markings fulfill the current standard AIM DPM-1-2006, which is required for directly marked components.

According to at least one embodiment, the method comprises the following steps: A) providing a blank, B) applying a marking to the blank in places, C) heating the blank with the marking to a deformation temperature, and D) deforming the blank to form the workpiece and cooling the workpiece, wherein deforming is a hot forming and the marking remains at the workpiece at least until after step D) and is not destroyed by deforming, and furthermore the marking has a difference in the degree of reflection and/or a difference in the degree of reflectance and/or a difference in albedo of at least 15 percentage points under suitable illumination conditions in at least part of the near ultraviolet, visible and/or near infrared spectral range both with respect to the blank and with respect to the workpiece, under suitable illumination conditions for the marking. In this case, the degree of reflectance preferably is the ratio of the illuminance reflected from a surface in a measurement direction to the luminance of a surface in reference white. The albedo is, in particular, a measure of the reflectivity of diffusely reflective surfaces.

The individual method steps may be carried out successively and in the stated order.

In accordance with at least one embodiment, the deformation temperature is at least 700° C. or 800° C. or 880° C. Alternatively or additionally, the deformation temperature is at most 1100° C. or 1000° C. or 950° C. In particular, the deformation temperature is approximately 930° C.

In the metal-processing industry, particularly in automotive engineering, workpieces and blanks are subjected to hot forming. For this purpose, for example, stamped, planar plates are heated to the deformation temperature and then deep-drawn, for instance. The high temperatures during deforming and cooling, carried out rapidly especially during pressing, serve for altering the strength of the material to be shaped.

Such components subjected to hot forming are produced in the automotive industry, for instance, in high numbers, of the order of magnitude of millions of items annually, for example, in body construction. For quality assurance, it is desirable to identify the produced workpieces individually, for instance, in order to be able to establish batch tracing.

Hitherto, hot-formed components have not been marked in a component-resolved manner. Only a batch identification is carried out, for example, by means of a shift stamp and by means of letter punches that are pressed into the plates. Such a shift stamp changes every eight hours, for example, with each shift. Such a stamp is generally no longer machine-readable after hot forming and, since large numbers are produced within a shift, such a stamp does not provide component resolution. Printing a barcode using conventional inks is not possible either, since such inks do not withstand temperatures such as the deformation temperature without damage. On account of anti-scaling protective layers, in particular, methods such as laser engraving also fail, since anti-scaling protective layers that cover a surface of the blank already typically melt below the deformation temperature and a laser engraving thus runs, is considerably reduced in contrast or damages the anti-scaling protective layer. Even in the case of methods such as dot matrix printing, the anti-scaling protective layer is potentially damaged. In the case where labels are applied, for instance, the problem of the high deformation temperature is accompanied by difficulties with subsequent adhesion of lacquer in the region of the label.

With the method described here, a marking can be applied in a component-resolved manner, wherein the marking withstands high temperatures and the marking is machine-readable, in particular, even after hot forming. A corresponding marking also enables good subsequent adhesion of further layers such as lacquer coatings.

In accordance with at least one embodiment, the marking comprises at least one thermally stable, coloring material or consists of one or a plurality of such materials. The thermally stable material is, for example, a ceramic having a different color than the blank and the workpiece. By way of example, the ceramic is white, colorful or black. There may be a plurality of partial regions of the marking which have different colors in order to ensure an increased contrast within the marking.

In accordance with at least one embodiment, the marking comprises one or a plurality of phosphors or consists of one or a plurality of phosphors. The at least one phosphor then brings about a difference in the degree of reflection between the marking and the blank and also the workpiece. Phosphors can have a degree of refection of more than 100% in this case in spectral subranges in which the phosphor emits by way of photoluminescence. A degree of reflection that goes beyond 100% is thus brought about by the secondary light generated by the phosphor.

The phosphor or the phosphor mixture preferably contains or consists of at least one of the following phosphors: $Eu^{2+}$-doped nitrides such as $(Ca,Sr)AlSiN_3:Eu^{2+}$, $Sr(Ca,Sr)Si_2Al_2N_6:Eu^{2+}$, $(Sr,Ca)AlSiN_3*Si_2N_2O:Eu^{2+}$, $(Ca,Ba,Sr)_2Si_5N_8:Eu^{2+}$, $(Sr,Ca)[LiAl_3N_4]:Eu^{2+}$; garnets from the general system $(Gd,Lu,Tb,Y)_3(Al,Ga,D)_5(O,X)_{12}:RE$ where X=halide, N or divalent element, D=trivalent or tetravalent element and RE=rare earth metals such as $Lu_3(Al_{1-x}Ga_x)_5O_{12}:Ce^{3+}$, $Y_3(Al_{1-x}Ga_x)_5O_{12}:Ce:^{3+}$; $Eu^{2+}$-doped sulfides such as $(Ca,Sr,Ba)S:Eu^{2+}$; $Eu^{2+}$-doped SiONs such as $(Ba,Sr,Ca)Si_2O_2N_2:Eu^{2+}$; SiAlONs, for instance, from the system $Li_xM_yLn_zSi_{12-(m+n)}Al_{(m+n)}O_nN_{16-n}$; beta-SiAlONs from the system $Si_{6-x}Al_zO_yN_{8-y}:Re_z$; nitrido-orthosilicates such as $AE_{2-x-a}RE_xEu_aSiO_{4-x}N_x$, $AE_{2-x-a}RE_xEu_aSi_{1-y}O_{4-x-2y}N_x$ where RE=rear earth metal and AE=alkaline earth metal; orthosilicates such as $(Ba,Sr,Ca,Mg)_2SiO_4:Eu^{2+}$; chlorosilicates such as $Ca_8Mg(SiO_4)_4Cl_2:Eu^{2+}$; chlorophosphates such as $(Sr,Ba,Ca,Mg)_{10}(PO_4)_6Cl_2:Eu^{2+}$; BAM phosphors from the $BaO—MgO—Al_2O_3$ system such as $BaMgAl_{10}O_{17}:Eu^{2+}$; halophosphates such as $M_5(PO_4)_3(Cl,F):(Eu^{2+}, Sb^{3+}, Mn^{2+})$; SCAP phosphors such as $(Sr,Ba,Ca)_5(PO_4)_3Cl:Eu^{2+}$. The phosphors specified in the document EP 2 549 330 A1 can also be used as phosphors. With regard to the phosphors used, the disclosure content of said document is incorporated by reference. Moreover, so-called quantum dots can also be introduced as converter material. Quantum dots in the form of nanocrystalline materials comprising a group II-VI compound and/or a group III-V compound and/or a group IV-VI compound and/or metal nanocrystals are preferred here.

The phosphor can be designed for shortening the wavelength of an excitation radiation, also referred to as up conversion, and can then convert infrared light into visible light, for example. Alternatively, the phosphor can convert short-wave light into long-wave light. The phosphor is excited in the near ultraviolet, visible and/or near infrared spectrum range. The phosphor is read preferably in the visible or near ultraviolet spectral range.

It is possible for the phosphor to be altered in terms of its luminescent properties in particular as a result of the temperatures during hot forming. As a result, it is also possible to achieve quality control as to whether the hot forming was carried out with correct process parameters.

In accordance with at least one embodiment, the blank and preferably also the finished shaped workpiece have an anti-scaling protective layer. The anti-scaling protective layer is designed to prevent or greatly slow down oxidation of the workpiece in the region of the deformation temperature in an oxygen-containing atmosphere.

In accordance with at least one embodiment, the anti-scaling protective layer comprises or consists of aluminum, silicon, zinc and/or at least one metal oxide. By way of example, the anti-scaling protective layer is a layer produced by means of hot dip galvanizing or a layer composed of an aluminum-silicon alloy. Protective layers composed of or comprising metal oxides such as aluminum oxide can also be used. The anti-scaling protective layer can likewise be a protective layer comprising nanometer-scale particles, for example, an x-tec coating from the manufacturer NANO-X GmbH. A thickness of the anti-scaling protective layer is, for example, at least 100 nm or 250 nm or 1 μm and/or at most 30 μm or 10 μm or 2 μm. A preferred composition of the anti-scaling layer reads: 87% Al, 10% Si and 3% Fe. The preferred thickness of the anti-scaling protective layer is 1.5 μm.

In accordance with at least one embodiment, the marking is applied directly to the anti-scaling protective layer in step B). The marking or a raw material for the marking is applied, for example, by means of analog printing such as screen printing or by means of digital printing such as inkjet. The marking or a raw material for the marking can likewise be applied by spraying or applied by means of a voltage-driven method such as electrophoresis or electroplating. By way of example, the marking or the raw material is applied as a paste or as a liquid having ink properties. The marking can likewise be applied by laser writing using dye powders, for instance, as specified in the document WO 2010/057470 A2. The disclosure content of said document is incorporated by reference.

In accordance with at least one embodiment, the marking or at least one constituent of the marking is partly or completely pressed into the anti-scaling protective layer in method step D). Preferably, at least part of the marking projects from the anti-scaling protective layer, such that the marking is at least partly not covered by the anti-scaling protective layer. In this case, it is possible for the marking or a constituent of the marking to make contact with a basic material of the blank on which the anti-scaling protective layer is applied. Preferably, however, there is no direct contact between the basic material of the blank and the marking.

In accordance with at least one embodiment, the marking remains permanently at the workpiece. In other words, the marking adheres to the blank and/or to the anti-scaling protective layer in such a way that no detachment or no significant detachment of the marking from the workpiece takes place during proper use of the finished workpiece.

In accordance with at least one embodiment, the marking comprises a matrix material. The matrix material is, for example, a light-transmissive, inorganic material, in particular a glass on the basis of silicon dioxide. The matrix material acts as an adhesion promoter and as an adhesive between the blank, in particular the anti-scaling protective layer, and a coloring material of the marking, in particular of the at least one phosphor.

In accordance with at least one embodiment, the marking comprises an organic matrix material, for example, acrylate-based. By means of this organic matrix material, the marking, in particular the coloring constituent of the marking, such as the phosphor, is fixed to the blank and/or the anti-scaling protective layer at least in step B). The matrix material than acts as a type of adhesive for the coloring constituent. In this case, the organic matrix material comprises, for example, a binder, an organic solvent, a dispersant and a plasticizer. In particular, use is made of a phosphor paste composition as described in the document DE 602 18 966 T2. The disclosure content of said document is incorporated by reference.

In accordance with at least one embodiment, the marking and/or the raw material for the marking and the anti-scaling protective layer have different melting points and/or softening points. Preferably, the melting point of the marking or of the raw material of the marking is at higher temperatures than the melting point of the anti-scaling protective layer. In particular, the melting point of the marking exceeds the melting point of the anti-scaling protective layer by at least 25° C. or 50° C. and/or by at most 300° C. or 200° C. or 100° C. Particularly preferably, the phosphor and/or pigments do(es) not melt at all during the method. Hereafter, the term pigment is also used as a generic term for color pigments without a phosphor property, that is to say without the capability of converting wavelengths, and for phosphors.

In accordance with at least one embodiment, the melting points and/or softening points of the anti-scaling protective layer and of the marking or of the raw material for the marking are below the deformation temperature. A temperature difference between the deformation temperature and the melting point of the marking or of the raw material is, for example, at least 50° C. or 100° C. or 150° C.

It is preferred for one part of the marking, in particular an adhesion promoter, to soften above the softening point of the anti-scaling layer, but below the deformation temperature. Another part of the marking, in particular the phosphor and/or the pigments, particularly preferably does not soften or softens only slightly, that is to say, for instance, only superficially, in the entire intended method, that is to say including at the deformation temperature. In this case, the phosphor and/or the pigments do(es) not alter its/their crystal structure, or do(es) not significantly alter said crystal structure, during the method, such that in particular the phosphor property is not lost.

If the marking contains an inorganic adhesion promoter for the adhesion between the pigment particles and the anti-scaling protective layer, which may be tantamount to an inorganic matrix material, then the adhesion promoter softens at temperatures between the melting point of the anti-scaling protective layer and the deformation temperature. The phosphor and/or the pigments do(es) not soften or soften(s) only scarcely during the method and a binding between the phosphor and/or the pigments and the component to be produced is achieved after cooling by the adhesion promoter and/or by sinking of the adhesion promoter and the pigments and/or phosphors bound thereto.

An anti-scaling protective layer composed of an Al—Si alloy, for example, has a melting point of approximately 600° C. Suitable glasses for the matrix material, that is to say for the inorganic adhesion promoter, then preferably have 600° C. and 670° C. as softening point and as melting point.

If the marking does not contain an inorganic adhesion promoter, but rather only the phosphor and/or the pigments as inorganic, solid component, then the phosphor and/or the pigments do(es) not soften or soften(s) only superficially during the method and a binding between the phosphor and/or the pigments and the component arises as a result of a binding of the phosphor and/or of the pigments with the anti-scaling protective layer and/or as a result of a sinking into the latter.

In accordance with at least one embodiment, the marking is removable from the finished shaped workpiece after step D) in a step E). Removal is preferably carried out by means of wiping away or rubbing away, in particular without the aid of liquid substances such as solvents or caustic liquids. Furthermore, preferably no or no significant removal of material of the workpiece takes place during the removal of the marking; in particular, the anti-scaling protective layer is maintained during the removal of the marking. Such a marking that can be wiped away is obtainable, for example, by the organic matrix material being decarbonized to the extent of 95% or completely in step C) and/or in step D). Such a removable marking enables a component identification during production in particular right up to directly before a lacquering process.

In accordance with at least one embodiment, the marking, as seen in plan view comprises a multiplicity of pointlike, island-shaped partial regions. The partial regions are separated from one another and not connected to one another by a material of the marking. A mean diameter of the partial regions is, for example, at 0.5 μm or 1 μm and/or at most 50 μm or 20 μm or 10 μm. In this case, the marking, as seen in plan view, is preferably assembled from the individual partial regions, which can be present in a density modulation. In this case, a mean extent of the marking overall is preferably at least 20 times or 50 times the mean diameter of the partial regions.

Preferably, the particles and/or pigments are present in a homogeneous, close-packed or approximately close-packed, in particular monolayer, distribution on the surface of the component. If island formation is provided, then a uniform distribution of the islands over the marking region is preferably present, such that the islands, as viewed by the naked eye or by a read-out system, appear to be continuous.

In accordance with at least one embodiment, a mean roughness, also designated as Ra, of a surface of the workpiece at the marking deviates from a mean roughness of remaining regions of the surface of the workpiece by at most a factor of 5 or 2 or 1.5. In other words, the marking has a roughness comparable to that of remaining regions of the workpiece. In particular, by running a finger over the marking, for instance, it is then not possible haptically to ascertain any difference with respect to remaining regions of the workpiece.

In accordance with at least one embodiment, the mean roughness of the surface of the workpiece at the marking deviates from the mean roughness of remaining regions of the surface by at least a factor of 2 or 5 or 10. As a result, the optical properties, in particular with regard to scattering, can be greatly different, which can increase the contrast for reading the marking.

In accordance with at least one embodiment, the marking is formed by one or a plurality of continuous marking regions. The individual marking regions constitute, for example, bars of a barcode, elements of a dot or matrix code or numerals, letters or symbols. Within the marking regions, the marking covers the workpiece completely, without gaps and continuously. A mean extent of the at least one marking region is preferably at least 20 times or 50 times a mean diameter of color pigments of the marking. In this case, the color pigments are, for example, ceramic, colored particles or phosphor particles.

In accordance with at least one embodiment, in a step F) after step D), one or a plurality of lacquers is/are applied to the workpiece. The at least one lacquer preferably completely covers the marking. It is possible for the marking no longer to be discernible to an observer or a reader through the lacquer. It may thus be the case that the marking becomes visible and readable again only as a result of the lacquer being removed. A structure or shape of the marking is preferably not or not significantly impaired by the lacquer.

Furthermore, a workpiece is specified. The workpiece is produced by a method as specified in association with one or more of the embodiments mentioned above. Therefore, features of the method are also disclosed for the workpiece, and vice versa.

In at least one embodiment, the workpiece comprises a hot-formed metal body, to which an anti-scaling protective layer is applied. A marking comprising color pigments is at least partly pressed into the anti-scaling protective layer. The marking has a reflection behavior deviating from the metal body and/or the anti-scaling protective layer, such that the marking is preferably machine-readable or readable by an observer.

BRIEF DESCRIPTION OF THE DRAWINGS

A method described here and a workpiece described here are explained in greater detail below on the basis of exemplary embodiments with reference to the drawing. In this case, identical reference signs indicate identical elements in the individual figures. However, relations to scale are not illustrated; rather individual elements may be illustrated with an exaggerated size in order to afford a better understanding. In the figures.

DETAILED DESCRIPTION OF ILLUSTRATIVE EMBODIMENTS

FIG. 1A-1E illustrate one exemplary embodiment of a method for producing a workpiece. In accordance with FIG. 1A, a blank 2 is provided. The blank 2 is preferably a steel.

Figure 1A:
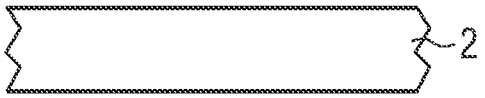
FIGS. 1A-1E show cross-sectional views of a method forming a deformed workpiece with markers and a lacquer disposed thereon according to embodiments.
Figure 1B:
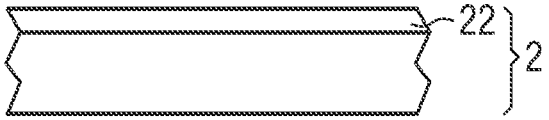

Optionally, see FIG. 1B, a blank 2 is provided which comprises an anti-scaling protective layer 22, for instance, composed of an aluminum-silicon alloy. In order to simplify the illustration, the anti-scaling protective layer 22 is depicted only at one side of the blank 2. Furthermore, a thickness of the anti-scaling protective layer 22 is illustrated with an exaggerated size. Such anti-scaling protective layers 22 are preferably also present in all the other exemplary embodiments. In a departure from a subsequent illustrations, however, the blanks 2 can also each be free of an anti-scaling protective layer 22.

Figure 1C:
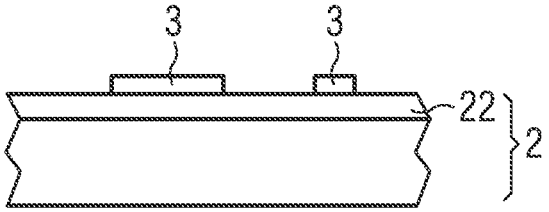

In the method step in FIG. 1C, a marking 3 is applied to the anti-scaling protective layer 22, preferably at room temperature, for example, by printing. The marking 3 comprises color pigments, preferably ceramic particles or phosphor particles, whereby the marking 3 is distinguishable from the blank 2 by a reader or by an observer, as seen in plan view.

Afterward, the blank 2 with the marking 3 is heated to a deformation temperature. The deformation temperature is approximately 930° C., for example.

Figure 1D:
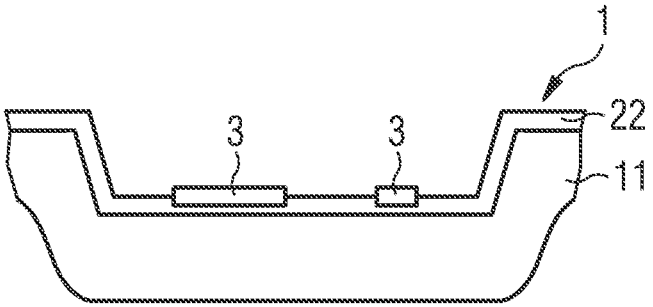

Subsequently, see FIG. 1D, the blank is deformed to form the workpiece 1. A metal body 11 arises in the process, said metal body determining the shape of the workpiece 1. The anti-scaling protective layer 22 is still situated on the metal body 11. Deforming to form the workpiece 1 makes it possible for the marking 3 to be intimately connected to the anti-scaling protective layer 22 or to the metal body 11. By way of example, the marking 3 is partly pressed and/or fused into the anti-scaling protective layer 22.

Shaping to form the metal body 11 is preferably deep-drawing. In this case, the blank 2 previously brought to the deformation temperature is introduced into a cooled mold (not illustrated) and pressed, thus giving rise to the metal body 11. In this case, a deformation temperature is preferably higher than the melting points of the anti-scaling protective layer 22 and of the marking 3, wherein a melting point of the marking 3 is higher than a melting point of the anti-scaling protective layer 22. In the cooled mold, the marking 3 then solidifies before the anti-scaling protective layer 22, thereby preventing or greatly reducing running of the marking 3 during deep-drawing.

Figure 1E:
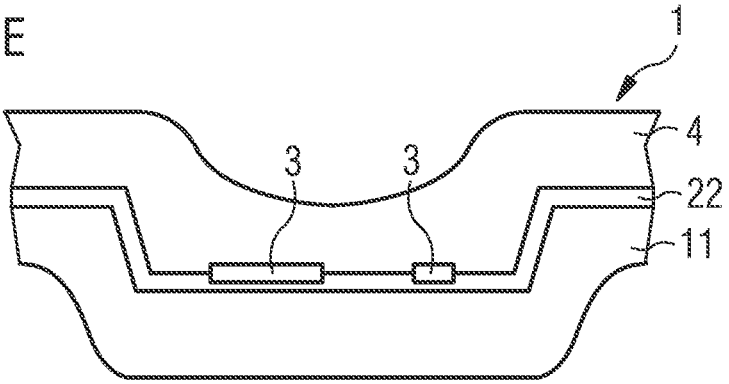

In the optional method step in FIG. 1E, a lacquer 4 is subsequently applied to the marking 3 and to the anti-scaling protective layer 22.

Figure 2A:
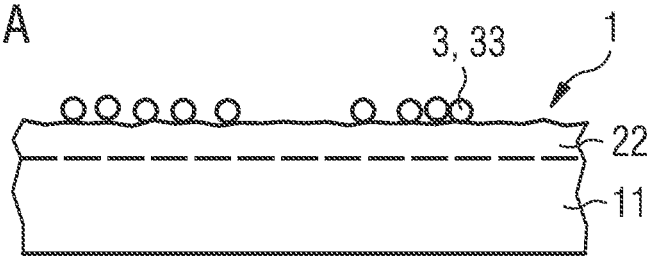
FIGS. 2A-2C show schematic sectional illustrations of markings located in undeformed regions of the finished workpiece according to embodiments.
Figure 2B:
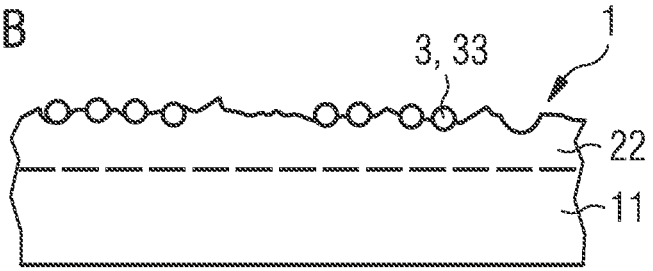
Figure 2C:
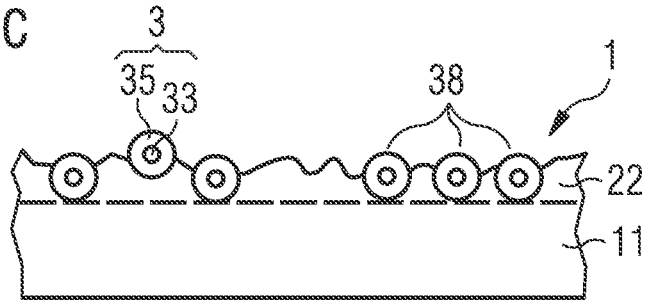

FIGS. 2A-2C illustrate exemplary embodiments of the finished workpieces 1, only undeformed regions of the workpieces 1 being illustrated in order to simplify the illustration. The marking 3, preferably also in all the other exemplary embodiments, is situated in regions of the workpiece 1 that are deformed little or are not deformed, thus simplifying later reading of the marking 3.

FIGS. 2A-2C, the marking 3 is formed in each case by particles which comprise or consist of a phosphor 33, likewise in particle form. A mean diameter of the particles is, for example, between 0.7 μm and 5 μm inclusive. The particles of the marking 3, which differ optically from the anti-scaling protective layer 22, are preferably present only in a plane and not stacked one above another.

In accordance with FIG. 2A, the particles of the marking 3 are applied on the anti-scaling protective layer 22 and are not or not significantly pressed into the anti-scaling protective layer 22. In other words, the marking is then elevated above the anti-scaling protective layer 22.

In the case of the exemplary embodiment in FIG. 2B, the particles of the marking 3 are partly pressed and/or fused into the anti-scaling protective layer 22. In this case, a surface roughness of the anti-scaling protective layer 22 is of the same order of magnitude as a mean diameter of the particles of the marking 3. In other words, the marking 3 produces no or no significant difference in a surface roughness.

FIG. 2C illustrates that the particles of the marking 3 at least partly penetrate through the anti-scaling protective layer 22 and are partly in contact with the metal body 11. In accordance with FIG. 2C, the particles of the marking 3 are largely integrated into the anti-scaling protective layer 22 and do not or not significantly project from the anti-scaling protective layer 22.

FIG. 2C additionally shows that the particles of the marking 3 comprise a phosphor 33, likewise in particle form. The phosphor 33 is embedded into a matrix material 35. The matrix material 35 is preferably a glass. By means of the matrix material, the particles of the marking 3 adhere to the anti-scaling protective layer 22, such that the marking 3 does not detach from the anti-scaling protective layer 22 during intended use of the workpiece 1. At the deformation temperature, in particular only the matrix material 35 melts, and the phosphor 33 does not melt. Such a construction of the particles of the marking 3 composed of a matrix material 35 and composed of phosphor particles 33 can also be present in the configurations in FIGS. 2A and 2B.

Figure 4A:
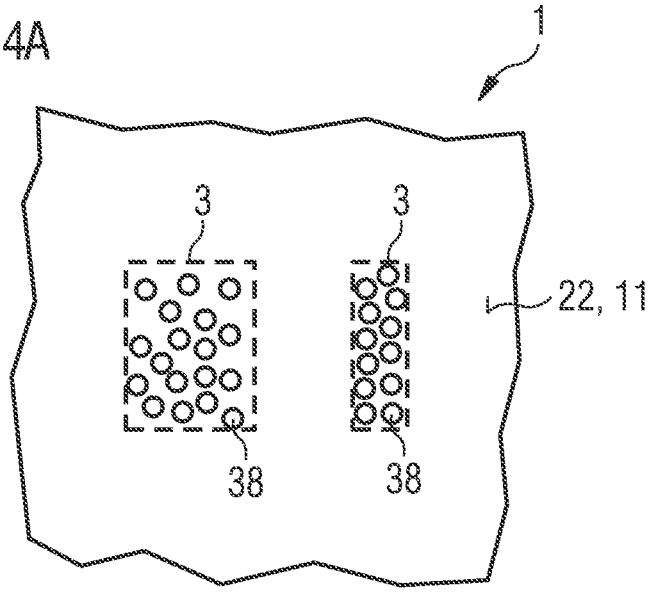
FIGS. 4A-4B show schematic plan views of a plurality of continuous marking regions according to embodiments.

The individual particles of the marking 3 form partial regions 38 that are grouped. By virtue of the grouped partial regions 38, see FIG. 4A, the marking 3 is shaped, for example, as a bar code or as lettering.

Figure 3:
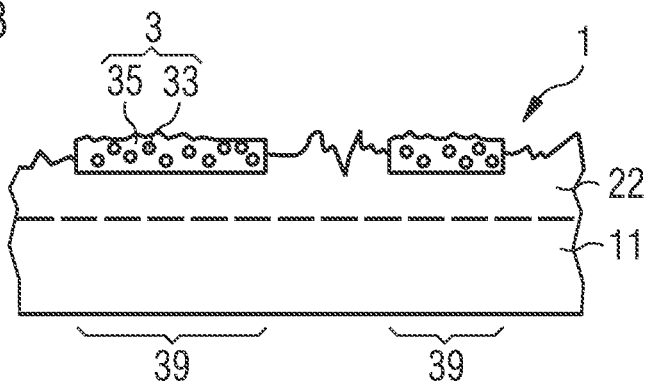
FIG. 3 shows a schematic sectional view of a plurality of continuous marking regions located on the workpiece according to embodiments.
Figure 4B:
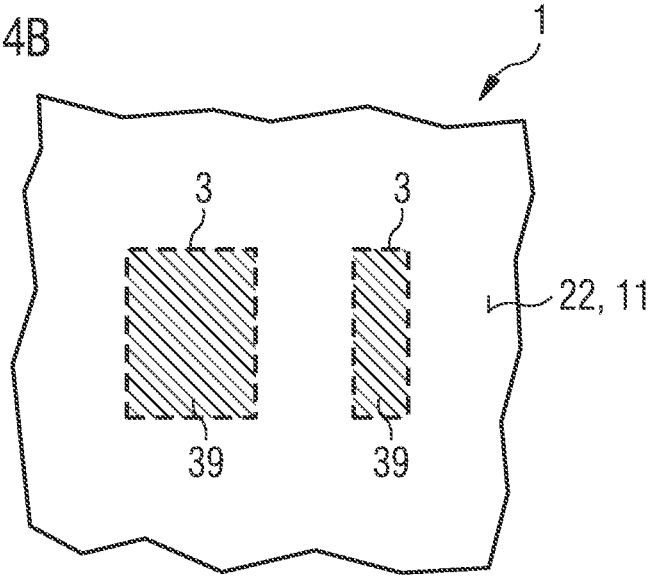

FIG. 3 shows that the marking is formed by a plurality of continuous marking regions 39, see also the plan view in FIG. 4B. A thickness of the marking regions 39 is, for example, at least 0.5 μm and/or at most 25 μm. In the marking regions 39, phosphor particles 33 can be present in a manner stacked one above another, said phosphor particles being embedded into the continuous matrix material 35.

It is possible for the marking regions 39 to be partly pressed into the anti-scaling protective layer 22. Likewise, the marking regions 39 preferably have a reduced surface roughness compared with the anti-scaling protective layer 22, as illustrated schematically in FIG. 3.

Also, analogously to FIGS. 2A and 2C, the marking regions 39 can be applied only on the anti-scaling protective layer 22 or extend as far as the metal body 11.

Figure 5A:
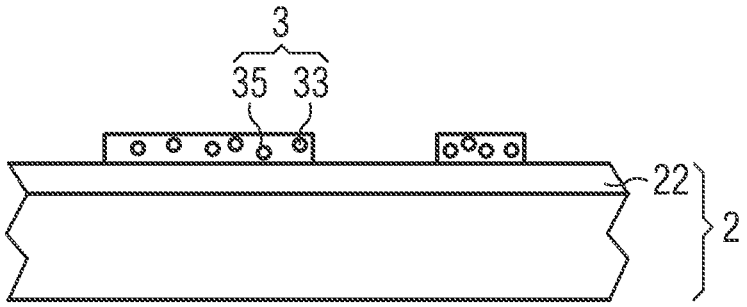
FIGS. 5A-5C show schematic sectional views of applying and removing of markings to the workpiece according to embodiments.
Figure 5B:
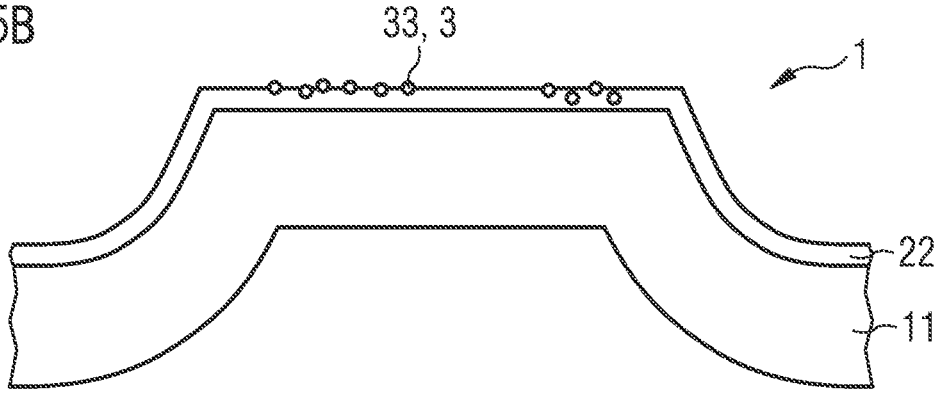
Figure 5C:
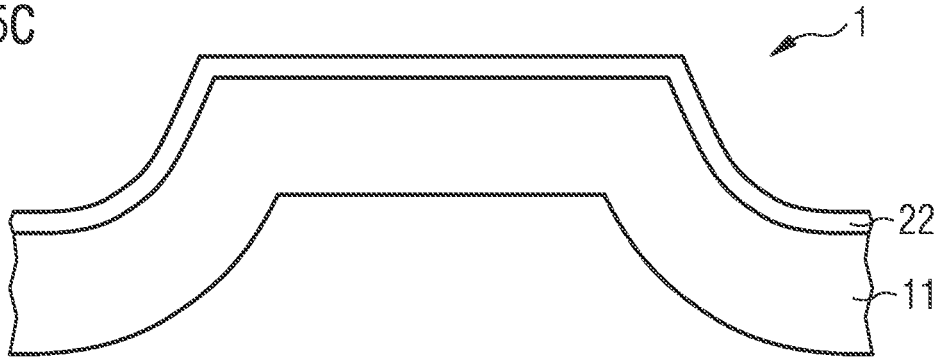

FIGS. 5A-5C show a further exemplary embodiment of the production method. The step in accordance with FIG. 5A corresponds here to the step in accordance with FIG. 1C, according to which the marking 3 is applied to the optional anti-scaling protective layer 22. In this case, the marking 3 comprises the particles 33 composed of the phosphor, for instance, which are embedded into an organic matrix material 35. The step in accordance with FIG. 5A preferably takes place at room temperature.

Afterward, the matrix material 35, which is an acrylic lacquer, in particular, is decarbonized during the heating of the blank 2 to the deformation temperature and/or during deep-drawing, such that only the phosphor particles 33 remain. In other words, the matrix material 35 preferably disappears without residue as a result of the elevated temperature during the production method.

In accordance with FIG. 5B, only the phosphor particles 33 then remain at the anti-scaling protective layer 22, without the matrix material 35.

Since the phosphor particles 33 are thus applied to the anti-scaling protective layer 22 without matrix material, it is possible, for example, directly before lacquering, not illustrated in FIGS. 5A-5C, to remove the phosphor particles 33, see FIG. 5C. The phosphor particles 33 are removed, for instance, by being wiped away with a dry cloth. In this case, the anti-scaling protective layer 22 and the metal body 11 remain intact.

The invention described here is not restricted by the description on the basis of the exemplary embodiments. Rather, the invention encompasses any novel feature and also any combination of features, which in particular includes any combination of features in the patent claims, even if this feature or this combination itself is not explicitly specified in the patent claims or exemplary embodiments.

What is claimed is:

1. A workpiece comprising:

a hot-formed metal body; and a marking consisting of an inorganic matrix material that is glass and of phosphor particles and/or ceramic colored particles which are at least partly arranged on the metal body and which are configured to exhibit a reflection behavior and/or a reflectance behavior and/or an albedo behavior deviating from the metal body, wherein the matrix material acts as an adhesion promoter and as an adhesive between the metal body and the phosphor particles and/or the ceramic colored particles, and wherein the phosphor particles consist of at least one of the following phosphors: $Eu^{2+}$-doped nitrides; garnets from the general system $(Gd,Lu,Tb,Y)_3(Al,Ga,D)_5(O,X)_{12}$:RE, where X=halide, N or divalent element, D=trivalent or tetravalent element and RE=rare earth metals; $Eu^{2+}$-doped SiONs; SiAlONs; beta-SiAlONs from the system $Si_{6-x}Al_zO_yN_{8-y}$:$RE_Z$; nitrido-orthosilicates; orthosilicates; chlorosilicates; chlorophosphates; BAM phosphors from a BaO-MgO-$Al_2O_3$ system; halophosphates; or $(Sr,Ba,Ca)_5(PO_4)_3Cl$:$Eu^2$.

2. The workpiece of claim 1, further comprising an anti-scaling protective layer applied to the metal body, wherein the marking is at least partly applied to the anti-scaling protective layer, and wherein the marking is configured to exhibit the reflection behavior and/or the reflectance behavior and/or the albedo behavior deviating from the metal body as well as from the anti-scaling protective layer.

3. The workpiece according to claim 2, wherein a melting point of the marking is at least 25° C. above a melting point of the anti-scaling protective layer.

4. The workpiece according to claim 2, wherein the anti-scaling protective layer comprises aluminum, silicon, zinc, iron and/or a metal oxide.

5. The workpiece according to claim 2, wherein the marking is elevated above the anti-scaling protective layer.

6. The workpiece according to claim 2, wherein the particles of the marking at least partly penetrate through the anti-scaling protective layer, are partly in contact with the metal body and do not project from the anti-scaling protective layer.

7. The workpiece according to claim 2, wherein the marking comprises a plurality of continuous marking regions, a thickness of the marking regions being at least 0.5 μm and at most 25 μm, wherein, in the marking regions, phosphor particles are present in a manner stacked one above another, the phosphor particles being embedded into a continuous matrix material, and wherein the marking regions have a reduced surface roughness compared with the anti-scaling protective layer adjacent to the marking regions.

8. The workpiece according to claim 2, wherein the marking is applied onto the anti-scaling protective layer and does not penetrate into the anti-scaling protective layer, the marking consisting of the inorganic matrix material and of the phosphor particles.

9. The workpiece according to claim 1, wherein the marking, as seen in plan view, is formed by a plurality of punctiform, island-shaped partial regions having a mean diameter of at most 50 μm, wherein the marking, as seen in plan view and considered with all partial regions taken together, has a mean extent of at least 20 times the mean diameter, and wherein a mean roughness of a surface of the workpiece at the marking deviates from a mean roughness of remaining regions of the surface by at most a factor of 2.

10. The workpiece according to claim 1, wherein the marking comprises at least one continuous marking region, wherein the at least one marking region has a mean extent of at least 20 times a mean diameter of color pigments of the marking.

11. The workpiece according to claim 1, wherein the marking is distant from the metal body.

12. The workpiece according to claim 1, wherein the marking is completely located in a recess of the metal body.

13. The workpiece according to claim 12, wherein a depth of the recess exceeds a thickness of the metal body.

14. The workpiece according to claim 1, wherein the marking is completely located on an elevation of the metal body.

15. A workpiece comprising:

a hot-formed metal body;

an anti-scaling protective layer directly on the metal body and composed of aluminum oxide and configured to prevent oxidation of the workpiece in an oxygen-containing atmosphere; and a marking composed of a decarbonized matrix material and a phosphor which are at least partly arranged on the metal body and which are configured to exhibit a reflection behavior and/or a reflectance behavior and/or an albedo behavior deviating from the metal body, wherein the phosphor consists of at least one of the following phosphors: $(Ca,Sr)AlSiN_3:Eu^{2+}$; $Sr(Ca,Sr)Si_2Al_2N_6:Eu^{2+}$; $(Sr,Ca)AlSiN_3*Si_2N_2O:Eu^{2+}$; $(Ca,Ba,Sr)_2Si_5N_8:Eu^{2+}$; $(Sr,Ca)[LiAl_3N_4]:Eu^{2+}$; $Lu_3(Al_{1-x}Ga_x)_5O_{12}:Ce^{3+}$; $Y_3(Al_{1-x}Ga_x)_5O_{12}:Ce:^{3+}$; $(Ca,Sr,Ba)S:Eu^{2+}$; $(Ba,Sr,Ca)Si_2O_2N_2:Eu^{2+}$; $Li_xM_yLn_zSi_{12-(m+n)}Al_{(m+n)}O_nN_{16-n}$; $Si_{6-x}Al_zO_yN_{8-y}:RE_Z$; $AE_{2-x-n}RE_xEu_aSiO_{4-x}N_x$, $AE_{2-x-n}RE_xEu_aSi_{1-y}O_{4-x-2y}N_x$, where RE=rear earth metal and AE=alkaline earth metal; $(Ba,Sr,Ca,Mg)_2SiO_4:Eu^{2+}$; $Ca_8Mg(SiO_4)_4Cl_2:Eu^{2+}$; $(Sr,Ba,Ca,Mg)_{10}(PO_4)_6Cl_2:Eu^{2+}$; $BaMgAl_{10}O_{17}:Eu^{2+}$; $M_5(PO_4)_3(Cl,F):(Eu^{2+}, Sb^{3+}, Mn^{2+})$; or $(Sr,Ba,Ca)_5(PO_4)_3Cl:Eu^{2+}$, and wherein the marking is applied directly to the anti-scaling protective layer.

* * * * *